US009339101B2

(12) United States Patent
Sung

(10) Patent No.: US 9,339,101 B2
(45) Date of Patent: May 17, 2016

(54) FIXATION MODULE

(71) Applicant: TWINHEAD INTERNATIONAL CORPORATION, Taipei (TW)

(72) Inventor: Cheng-Hung Sung, Taipei (TW)

(73) Assignee: Twinhead International Corporation, Taipei (TW)

( * ) Notice: Subject to any disclaimer, the term of this patent is extended or adjusted under 35 U.S.C. 154(b) by 610 days.

(21) Appl. No.: 13/837,523

(22) Filed: Mar. 15, 2013

(65) Prior Publication Data

US 2014/0215764 A1 Aug. 7, 2014

(30) Foreign Application Priority Data

Feb. 5, 2013 (TW) ..... 102104437 A

(51) Int. Cl.
*A45F 5/00* (2006.01)
*A45C 13/20* (2006.01)

(52) U.S. Cl.
CPC . *A45F 5/00* (2013.01); *A45C 13/20* (2013.01); *A45F 2200/0525* (2013.01); *Y10T 24/1397* (2015.01)

(58) Field of Classification Search
CPC .... A45F 5/00; A45F 2200/0525; A45C 13/30
See application file for complete search history.

(56) References Cited

U.S. PATENT DOCUMENTS 5,551,615 A * 9/1996 McIntosh ..... A45F 5/00 224/250
5,639,004 A * 6/1997 Carlton ..... A45C 9/00 190/125
5,938,096 A * 8/1999 Sauer ..... A47B 23/002 190/109
6,381,127 B1 * 4/2002 Maddali ..... G06F 1/163 224/257
6,530,475 B1 * 3/2003 Penney ..... G06F 1/1628 190/110
8,109,421 B2 * 2/2012 McLean ..... A45C 11/00 190/100
2009/0120987 A1 * 5/2009 Calayo ..... A45F 5/00 224/660
2011/0309123 A1 * 12/2011 Ashenafi ..... A45F 3/14 224/627
2012/0247983 A1 * 10/2012 Maravilla ..... A45F 5/00 190/100
2012/0267409 A1 * 10/2012 Chavis ..... A45F 5/00 224/579
2013/0092562 A1 * 4/2013 Wyner ..... A45C 11/00 206/45.23

* cited by examiner

*Primary Examiner* — Brian D Nash
(74) *Attorney, Agent, or Firm* — Muncy, Geissler, Olds & Lowe, P.C.

(57) ABSTRACT

A fixation module is disclosed, which is disposed in a groove at a corner of an electronic device casing. The fixation module includes a buckle and a fixation element with both ends serving as a first elastic fixation portion and a second elastic fixation portion respectively. A junction is disposed between the first elastic fixation portion and the second elastic fixation portion and connected to the buckle. The first elastic fixation portion and the second elastic fixation portion are clamped at a position corresponding to the junction, so as to keep a relative distance between the first elastic fixation portion and the second elastic fixation portion smaller than an interval between two opposite ends of the groove. By utilizing an elastic restoring force between the first elastic fixation portion and the second elastic fixation portion, the fixation element can be engaged onto a sidewall of the groove.

11 Claims, 7 Drawing Sheets

(b)

(a)

FIXATION MODULE

CROSS-REFERENCE TO RELATED APPLICATION

This application claims the benefit of Taiwan Patent Application No. 102104437, filed on Feb. 5, 2013, in the Taiwan Intellectual Property Office, the entire content of which is incorporated herein by reference.

FIELD OF THE INVENTION

The present invention relates to a fixation module, and more particularly to the fixation module that can be detachably mounted onto a casing of an electronic device to facilitate buckling the electronic device onto another object.

BACKGROUND OF THE INVENTION

As science and technology advance, electronic products are developed continuously from the inconvenient desktop computer in the past to the relatively heavy notebook computers, and then to the convenient portable tablet PCs and Smartphones now. Due to the factor of portability, the tablet PC and Smartphone gradually replace the notebook computer. To meet different user requirements, the tablet PC and the Smartphone come with all kinds of applications, not only providing the functions of making calls and sending short messages, but also allowing users to log on network, take pictures and play video games. After a user has taken a picture, the user can share the taken picture or movie with others in a website immediately via network without requiring an additional camera or notebook computer. Therefore, the tablet PC and Smartphone have become one of the necessary items in our life.

Although the tablet PC and Smartphone have the aforementioned advantages, most casings of the tablet PCs and Smartphones do not come with a design to facilitate uses to hang the tablet PC or Smartphone onto another object. If a user suddenly needs to move to another location, the user has to carry the tablet PC or Smartphone by hand or put the tablet PC or Smartphone device into a backpack or handbag before moving. Obviously, the portability and convenience of the devices still require further improvements.

In view of the aforementioned problem of the prior art, the inventor of the present invention designed and developed a fixation module to overcome the aforementioned problem and improve industrial applications.

SUMMARY OF THE INVENTION

Therefore, it is a primary objective of the present invention to provide a fixation module to overcome the problem a conventional electronic device that is inconvenient to carry.

To achieve the aforementioned objective, the present invention provides a fixation module movably installed into a groove at a corner of a casing of an electronic device, and the fixation module comprises a buckle and a fixation element. Both ends of the fixation element are a first elastic fixation portion and a second elastic fixation portion, and a junction is disposed between the first elastic fixation portion and the second elastic fixation portion and coupled to the buckle, and the first elastic fixation portion and the second elastic fixation portion are clamped at the junction to form a V-shape, and a relative distance between the first elastic fixation portion and the second elastic fixation portion is greater than an interval between opposite ends of the groove. When an external force is applied to the first elastic fixation portion and the second elastic fixation portion to make the relative distance smaller than the interval, the first elastic fixation portion and the second elastic fixation portion movably embedded into the groove, and the fixation element is engaged onto a sidewall of the groove by an elastic restoring force of the first elastic fixation portion and the second elastic fixation portion.

Preferably, the fixation module further comprises a connecting portion protruded outwardly from a side of the first elastic fixation portion or the second elastic fixation portion, and the casing having a ditch interconnected to the groove, and a sidewall of the ditch including a first installing hole, such that when the first elastic fixation portion and the second elastic fixation portion are embedded into the groove, the connecting portion is extended along the ditch and moved from an open end of the groove a predetermined position, so that the position of the connecting portion is corresponsive to the first installing hole.

Preferably, the fixation module further comprises a first connecting element passed through the connecting portion and the first installing hole to fix the fixation element to the casing.

Preferably, the fixation module further comprises a protecting element including a protecting perforation, and a press-fit portion protruded from an end of the protecting element, and the casing including a second installing hole formed at the periphery of the ditch, such that when the protecting element is covered onto the ditch, the position of the protecting perforation is corresponsie to the second installing hole, and the press-fit portion presses at a side of the buckle.

Preferably, the fixation module further comprises a buffer element including a buffer perforation, such that when the buffer element is covered onto the protecting element, the position of the buffer perforation is corresponsive to the protecting perforation.

Preferably, the fixation element further comprises a second connecting element passed through the buffer perforation, the protecting perforation and the second installing hole to fix the protecting element and the buffer element onto the casing.

Preferably, the fixation element is embedded into the groove for installing the fixation module to the electronic device, and after the position of the connecting portion is corresponsive to the position of the first installing hole, the first connecting element is passed through the connecting portion and fixed to the first installing hole.

Preferably, the buffer element is covered onto a side of the protecting element, and the position of the buffer perforation is corresponsive to the position of the protecting perforation, and then a combination of the buffer element and the protecting element is covered onto the ditch of the electronic device, so that the positions of the buffer perforation and the protecting perforation are corresponsive to the second installing hole formed at the periphery of the ditch, and the press-fit portion presses on a side of the buckle.

Preferably, the second connecting element is passed through the buffer perforation and the protecting perforation and fixed to the second installing hole, after a combination of the buffer element and the protecting element is covered onto the ditch.

To achieve the aforementioned objective, the present invention further provides a fixation module movably installed into a groove at a corner of a casing of an electronic device, and the casing has a ditch interconnected to the groove, and a sidewall of the ditch includes a first installing hole, and the fixation module comprises a buckle, a fixation element and a first connecting element. Both ends of the fixation element serve as a first elastic fixation portion and a second elastic fixation portion respectively, and a connecting portion is protruded outwardly from a side of the first elastic fixation portion or the second elastic fixation portion, and a junction is disposed between the first elastic fixation portion and the second elastic fixation portion and coupled to the buckle, and the first elastic fixation portion and the second elastic fixation portion are clamped at the junction to form a V-shape, and a relative distance between the first elastic fixation portion and the second elastic fixation portion is greater than an interval between opposite ends of the groove, such that when an external force is applied to the first elastic fixation portion and the second elastic fixation portion to keep the relative distance smaller than the interval, the first elastic fixation portion and the second elastic fixation portion can be movably embedded into the groove, and the fixation element is engaged onto a sidewall of the groove by an elastic restoring force of the first elastic fixation portion and the second elastic fixation portion, and the connecting portion is moved along the ditch from an open end of the groove to a predetermined position, the position of the connecting portion is corresponsive to the first installing hole, and the first connecting element is passed through the connecting portion and the first installing hole to fix the fixation element to the casing.

In summation, the fixation module of the present invention has one or more of the following advantages:

(1) In the fixation module of the present invention, both ends of the elastic plate are pressed to insert the iron plate into a groove of an electronic device, such that the iron plate can be engaged into the groove by using the elastic restoring force of both ends of the iron plate, so that the electronic device with the fixation module can be hanged or buckled to an object such as a belt, a bag or a wall to provide a convenient way for users to carry or hang the electronic device.

(2) In the fixation module of the present invention, the elastic iron plate further has a locking hole formed thereon, so that when the elastic iron plate is inserted into the groove of the electronic device, a screw can be passed through the locking hole and an installing hole of the electronic device to strength the locking force between the elastic iron plate and the electronic device to assure that the fixation module will not fall out from the electronic device during use, so as to prevent the electronic device from being damaged when it falls down.

(3) The fixation module of the present invention further comprises a shelter element and a buffer element, such that after the shelter element is covered onto the ditch, and the buffer element is covered onto the exterior of the shelter element, the fixation module can prevent foreign substances from entering into the ditch and prevent the buckle from falling out, so as to reduce the chance of damaging the electronic device by collisions.

DESCRIPTION OF THE PREFERRED EMBODIMENTS

The technical characteristics, contents, advantages and effects of the present invention will be apparent with the detailed description of a preferred embodiment accompanied with related drawings as follows. It is noteworthy that same numerals are used to represent respective elements in the following preferred embodiments.

Figure 1:
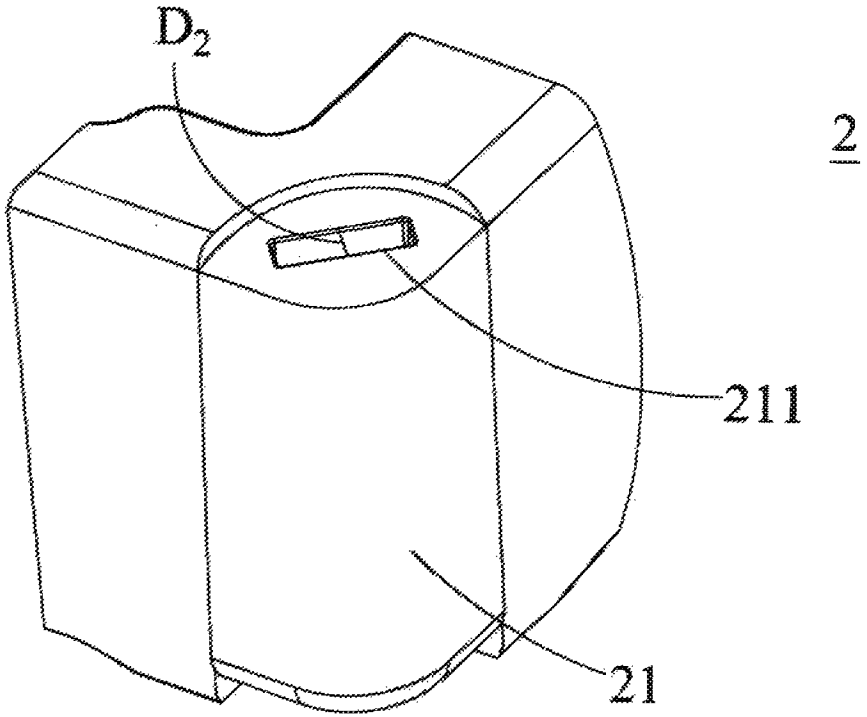
FIG. 1 is a schematic view of a fixation module and an applicable electronic device thereof according to the present invention.
Figure 1:
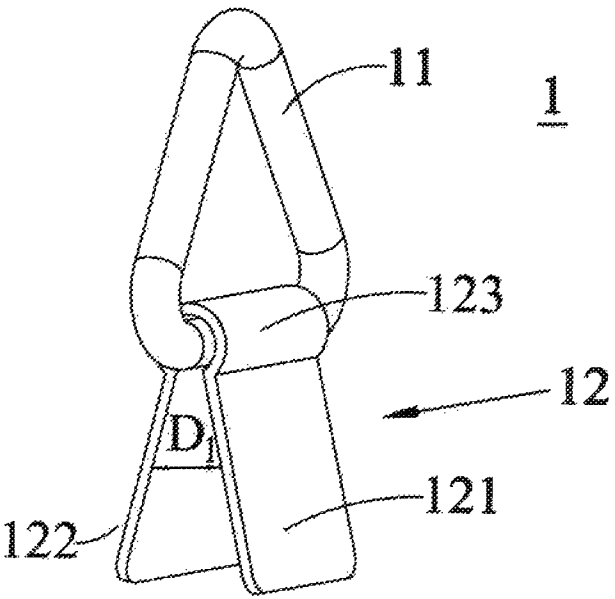
Figure 2:
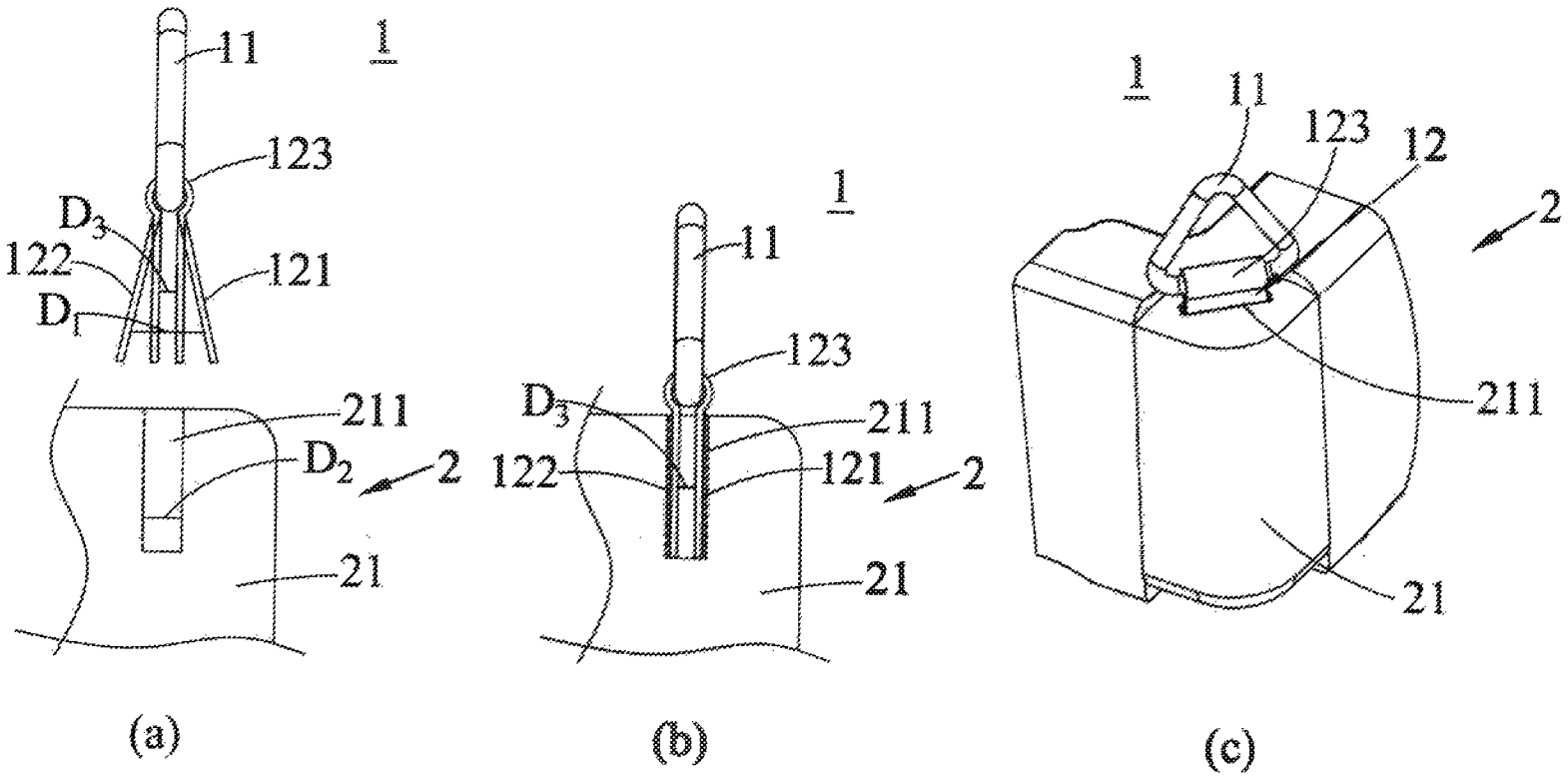
FIG. 2 is a schematic view of the fixation module according to a first preferred embodiment of the present invention.
Figure 3:
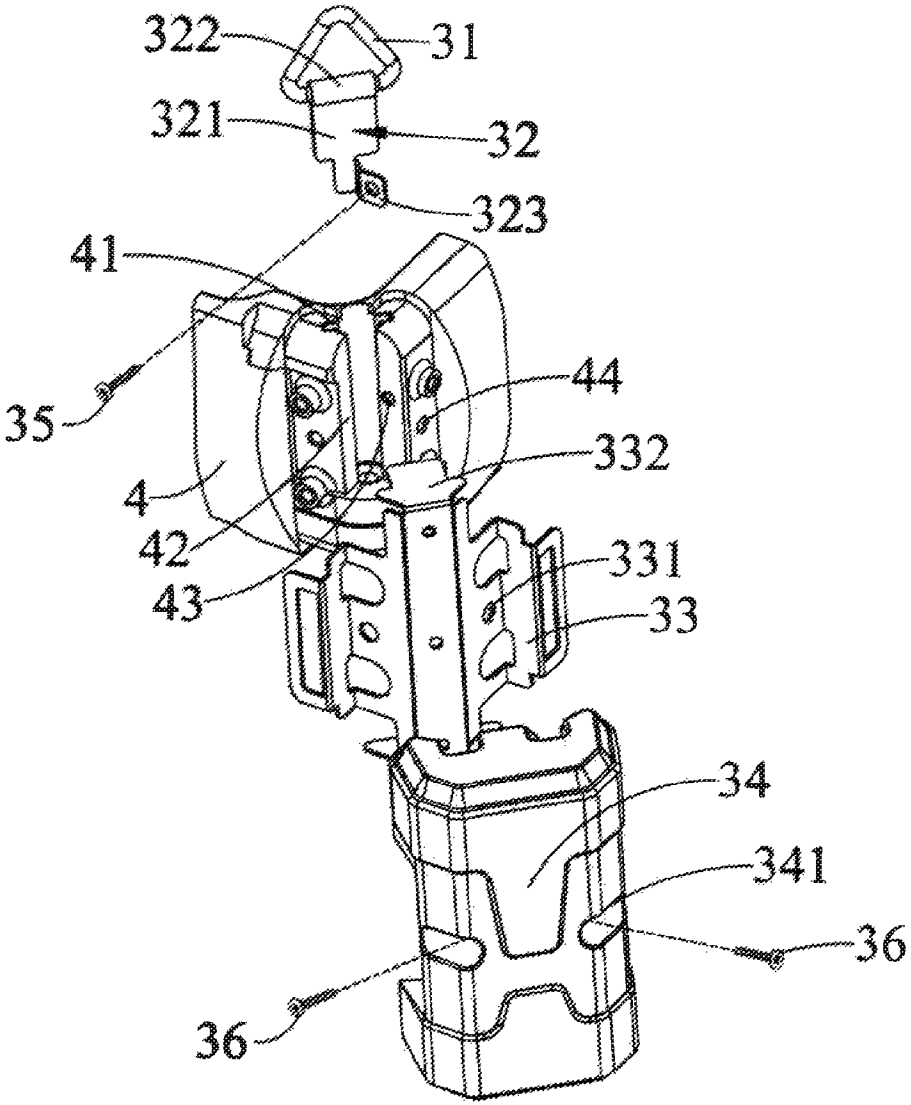
FIG. 3 is a first schematic view of the fixation module according to a second preferred embodiment of the present invention.
Figure 4:
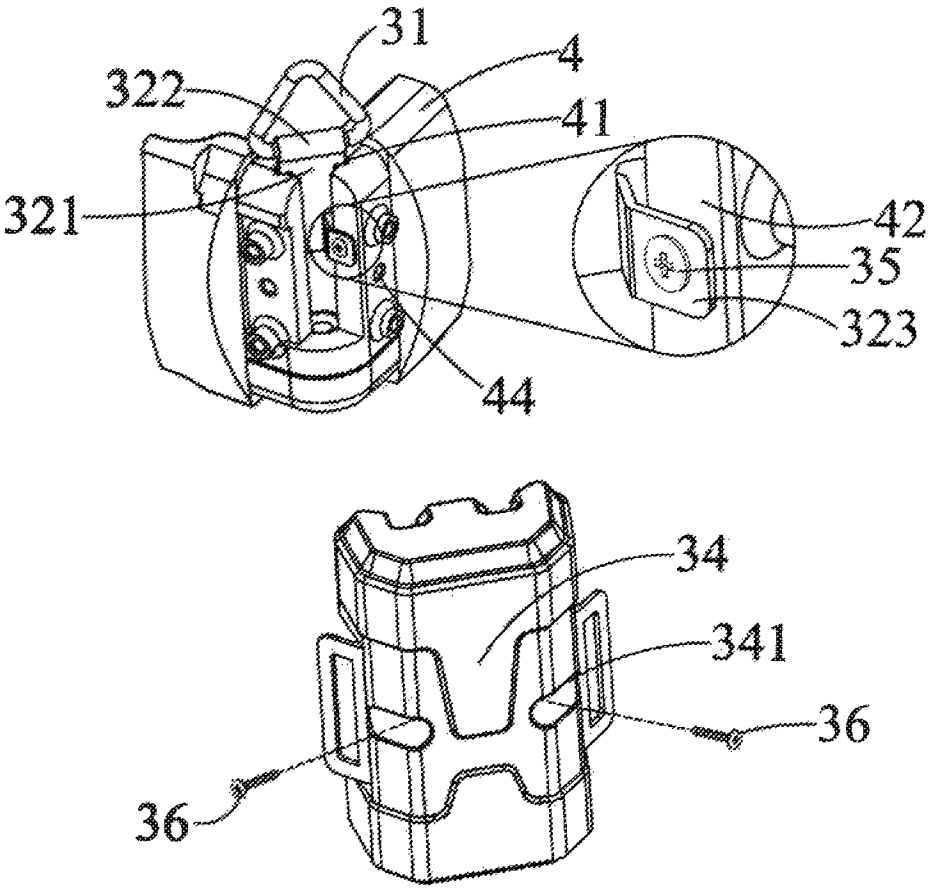
FIG. 4 is a second schematic view of the fixation module according to the second preferred embodiment of the present invention.
Figure 5:
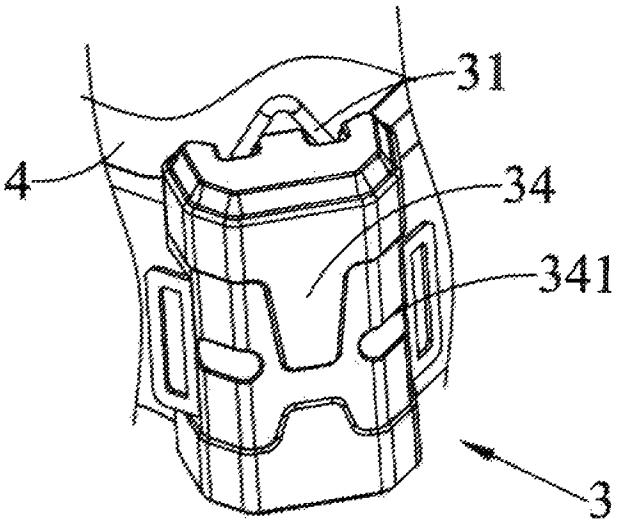
FIG. 5 is a third schematic view of the fixation module according to the second preferred embodiment of the present invention.
Figure 6:
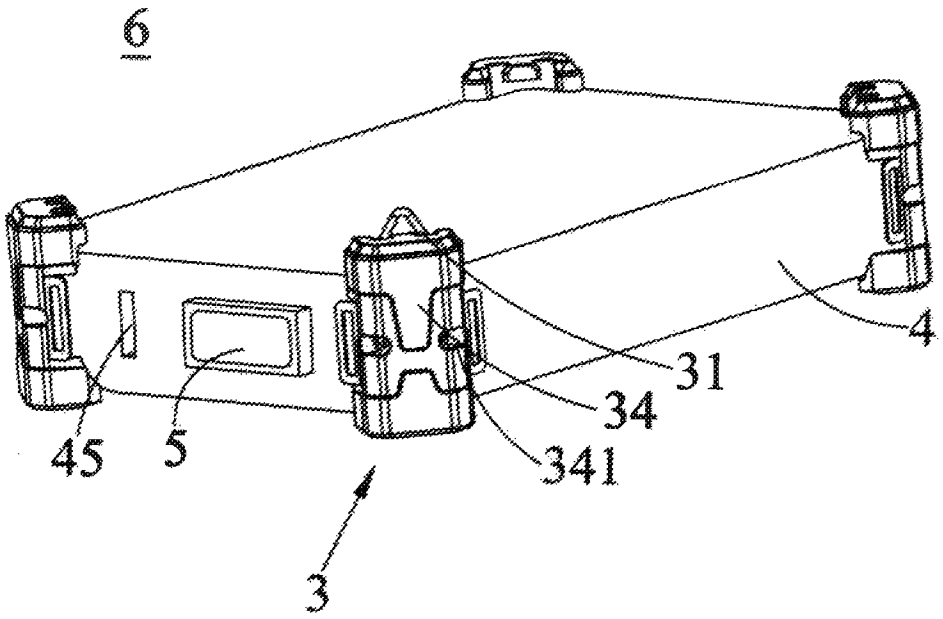
FIG. 6 is a fourth schematic view of the fixation module according to the second preferred embodiment of the present invention.

With reference to FIGS. 1 to 2, FIGS. 1(*a*) and 1(*b*) are schematic views of a fixation module and its applicable electronic device of the present invention and FIG. 2 is a first schematic view of a fixation module in accordance with a first preferred embodiment of the present invention, wherein FIGS. 2(*a*) to 2(*c*) are the first to third schematic views of a fixation module mounted onto an electronic device in accordance with the present invention respectively.

In FIG. 1(*a*), the fixation module 1 of the invention comprises a buckle 11 and a fixation element 12. The fixation element 12 includes a first elastic fixation portion 121, a second elastic fixation portion 122 and a junction 123. Wherein, the first elastic fixation portion 121 and the second elastic fixation portion 122 are disposed at both ends of the fixation element 12 respectively, and a relative distance D1 is defined between the first elastic fixation portion 121 and the second elastic fixation portion 122. A junction 123 is disposed between the first elastic fixation portion 121 and the second elastic fixation portion 122 and coupled to the buckle 11. In FIG. 1(*b*), the electronic device 2 applicable of using the fixation module 1 of the present invention comprises a casing 21, a groove 211 formed at a corner or an edge of the casing 21, and an interval D2 defined between opposite ends of the groove 211.

The buckle 11 can be made of plastic or metal, and the buckle 11 can be a triangular structure. However, the buckle 11 of the present invention is not limited to this shape only, but it can be in a square shape or a circular shape. In addition, the buckle 11 is not limited to a closed-ring design only, but the buckle 11 can be designed with a clamping function to facilitate users to clamp the buckle 11 onto another object.

The fixation element 12 is made of an elastic metal and manufactured into an elastic metal plate, but not limited thereto. Alternatively, the fixation element 12 is a plastic plate, and a spring or any other equivalent elastic components is installed between the first elastic fixation portion 121 and the second elastic fixation portion 122, such that when an external force is exerted onto the first elastic fixation portion 121 and the second elastic fixation portion 122, an outward elastic restoring force is produced similarly. Wherein, the junction 123 of the first elastic fixation portion 121 and the second elastic fixation portion 122 is an end point, so that the first elastic fixation portion 121, the second elastic fixation portion 122 and the junction 123 constitute a V-shaped structure, or the junction 123 is an end point protruded outwardly from the fixation element 12, so that the first elastic fixation portion 121, the second elastic fixation portion 122 and the junction 123 constitute a Y-shaped structure.

In a manufacturing process of connecting the fixation element 12 and the buckle 11 as shown in FIG. 2(*a*), the first elastic fixation portion 121 or the second elastic fixation portion 122 is passed through the buckle 11, and then the first elastic fixation portion 121 and the second elastic fixation portion 122 are pressed to from a V-shaped structure, and the junction 123 is disposed at the bending position, such that the junction 123 can be engaged with the buckle 11. If the junction 123 is a protruding end point of the fixation element 12, and the fixation element 12 is a Y-shaped structure, then the junction 123 can be coupled to the buckle 11 by a soldering or clamping method.

After the first elastic fixation portion 121 and the second elastic fixation portion 122 of the fixation element 12 are compressed by an external force and embedded into the groove 211 of the electronic device 2, and before the fixation element 12 is embedded into the groove 211, a relative distance D1 between the first elastic fixation portion 121 and the second elastic fixation portion 122 is greater than an interval D2 of the groove 211. If a user wants to installed the fixation module 1 of the present invention to the electronic device 2, the user can laminate the first elastic fixation portion 121 with the second elastic fixation portion 122, so that a relative distance D3 between the first elastic fixation portion 121 and the second elastic fixation portion 122 is smaller than an interval D2 of the groove 211, and then the fixation element 12 is embedded into the groove 211. Since the fixation element 12 is an elastic plate, the laminated first and second elastic fixation portion 121, 122 of the fixation element 12 produces an elastic restoring force opposite to each other, so that the fixation element 12 can be engaged onto the internal wall of the groove 211 by the elastic restoring force as shown in FIGS. 2(*b*) and 2(*c*).

With reference to FIGS. 3 to 6 for the first to fourth schematic views of a fixation module in accordance with the second preferred embodiment of the present invention respectively. The fixation module applicable for being used in an electronic device 6 comprises a device body 4, a data processing module 5, and a communication interface (not shown in the figure). The device body 4 comprises a groove 41, a ditch 42, a first installing hole 43, a second installing hole 44, an operating interface (not shown in the figure) and an electronic slot 45. The fixation module 3 of the present invention comprises a buckle 31, a fixation element 32, a protecting element 33, a buffer element 34, a first connecting element 35 and a second connecting element 36. The fixation element 32 comprises a first elastic fixation portion 321, a second elastic fixation portion (not shown in the figure), a junction 322 and a connecting portion 323. The protecting element 33 comprises a protecting perforation 331 and a press-fit portion 332. The buffer element 34 comprises a buffer perforation 341. Wherein, the protecting element 33 can be made of plastic or metal, and the buffer element 34 can be made of rubber or any other elastic material, but not limited thereto.

Wherein, the groove 41 is formed at one or more corners of the device body 4 or on a side of the device body 4. The ditch 42 is formed on a side of the device body 4 and interconnected to the groove 41. The first installing hole 43 is formed on a sidewall of the ditch 42. The second installing hole 44 is formed on the periphery of the ditch 42. The operating interface is disposed on a surface of the device body 4 which can be a touch screen provided for a user to operate the electronic device 6 of the present invention. The electronic slot 45 is formed at an edge of the device body 4, and the electronic slot 45 includes a USB slot or card slot, but not limited thereto. The electronic slot 45 is provided for electrically connecting the electronic device 6 of the present invention with a peripheral electronic device. The data processing module 5 is electrically coupled to the electronic device 6 without being limited by any particular installation method. The data processing module 5 can be a scanner, a card reader or any similar processing device for scanning a graphic label and converting the graphic label into an electric signal applicable for the manufacture. In a preferred embodiment, the data processing module 5 further includes an inspection area for inspecting the scanned graphic label. The communication interface (not shown in the figure) is used to provide communications between the data processing module 5 and the electronic device 6.

In addition, the buckle 31 is provided for users to engage the fixation module 3 onto another object. The first elastic fixation portion 321 and the second elastic fixation portion are disposed at both ends of the fixation element 32 respectively, and a junction 322 is disposed between the first elastic fixation portion 321 and the second elastic fixation portion and coupled to the buckle 31 by a soldering or linking method. A connecting portion 323 is protruded outwardly from a side of the first elastic fixation portion 321 or the second elastic fixation portion and provided for users to secure the connecting portion 323 to the device body 4 by screws or other locking devices. The press-fit portion 332 of the protecting element 33 is protruded outside an end of the protecting element 33, such that when the protecting element 33 is covered onto the ditch 42, the protecting element 33 can be used to prevent foreign substances from entering into the ditch 42, and the press-fit portion 332 is laminated onto a side of the buckle 31 to prevent the buckle from falling off.

When a user wants to install the fixation module 3 to the electronic device 6, the user presses both ends of the fixation element 32, such that the first elastic fixation portion 321, the second elastic fixation portion, and the junction 322 form a V-shape, and a relative distance between the first elastic fixation portion 321 and the second elastic fixation portion is smaller than an interval between two opposite ends of the groove 41, and then the fixation element 32 is embedded into the groove 41. After the first elastic fixation portion 321 and the second elastic fixation portion of the fixation element 32 are laminated to produce an elastic restoring force opposite to each other, so that the fixation element 32 can be engaged with the internal wall of the groove 41 by the elastic restoring force.

When the first elastic fixation portion 321 and the second elastic fixation portion are embedded into the groove 41, the connecting portion 323 is moved along the ditch 42 from open end of the groove 41 to the position corresponding to the first installing hole 43, and then the first connecting element 35 is passed through the connecting portion 323 and the first installing hole 43. Therefore, the fixation element 32 can be engaged into the groove 41 by the elastic restoring force of the first elastic fixation portion 321 and the second elastic fixation portion. By using the first connecting element 35 to lock the connecting portion 323 onto the sidewall of the ditch 42, the device body 4 can be fixed. Therefore, the fixation element 32 can be engaged onto the internal wall of the groove 41 by the elastic restoring force, and also can be locked onto the sidewall of the ditch 42 by the connecting portion 323 to fix the fixation element 32 to the device body 4.

After the buckle 31 and the fixation element 32 are installed to the device body 4, users can cover the buffer element 34 onto the protecting element 33, such that the position of the buffer perforation 341 is corrsponsive to the protecting perforation 331, and then a combination of the protecting element 33 and the buffer element 34 is covered onto the ditch 42, so that the positions of the protecting perforation 331 and the buffer perforation 341 are corrsponsive to the second installing hole 44, and the press-fit portion 332 is laminated onto a side of the buckle 31, but the order of installing the fixation element 32 into the groove 41 and covering the buffer element 34 onto the protecting element 33 is not limited, and users can cover the buffer element 34 onto the protecting element 33 and then embed the fixation element 32 into the groove 41 and then cover a combination of the protecting element 33 and the buffer element 34 onto the ditch 42. Finally, the users can pass the second connecting element 36 through the buffer perforation 341, the protecting perforation 331 and the second installing hole 44 to lock the protecting element 33 and the buffer element 34 onto the device body 4. In a preferred embodiment, the buffer element 34 can be installed on the protecting element 33 or installed around the edges of the device body 4, and such design can reduce the chance of damaging the electronic device 6 by collisions.

Figure 7:
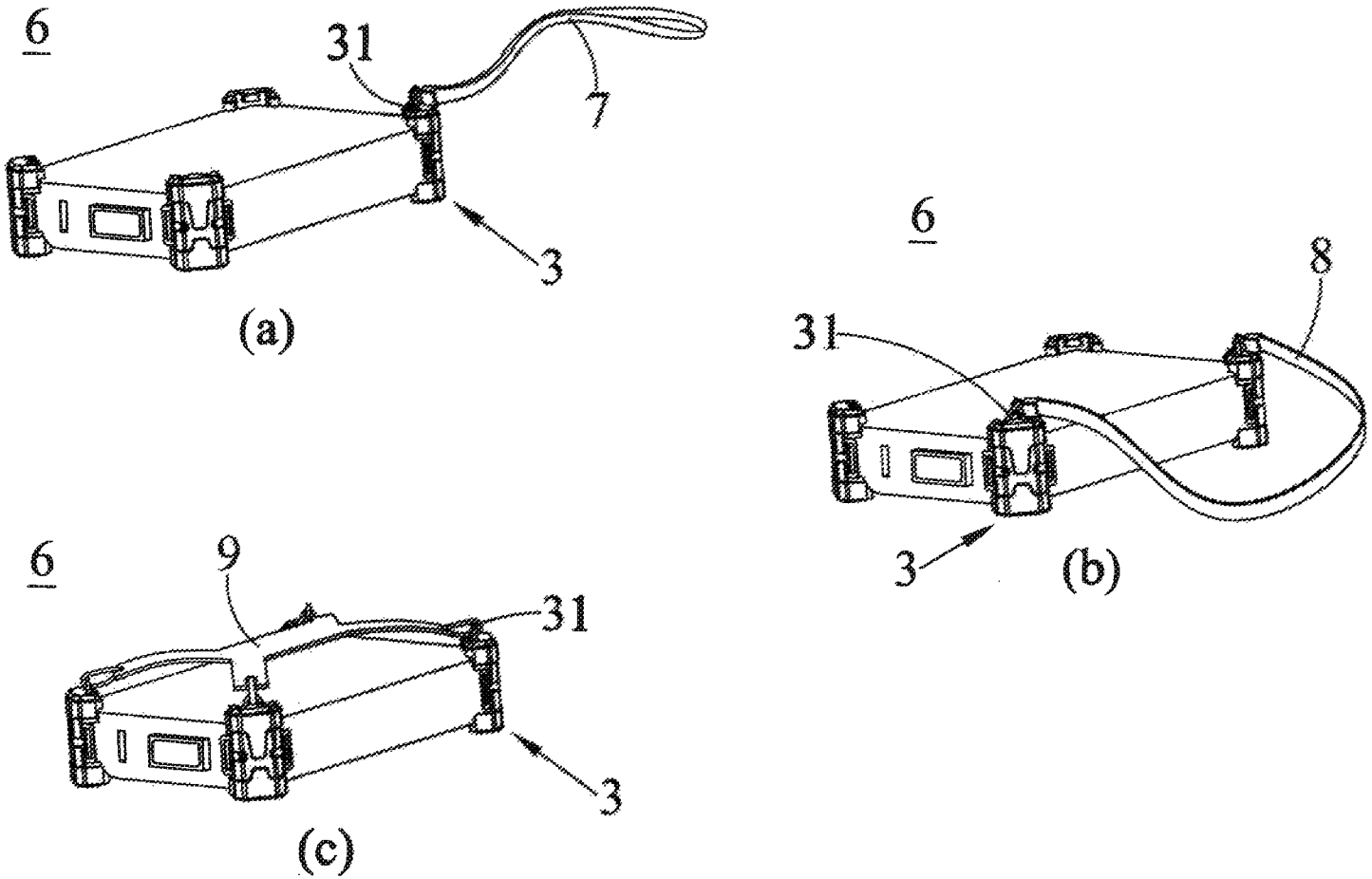
FIG. 7 is a fifth schematic view of the fixation module according to the second preferred embodiment of the present invention.

With reference to FIG. 7 for the fifth schematic view of a fixation module in accordance with the second preferred embodiment of the present invention, FIG. 7(*a*) is a schematic view of fastening a fixation module of the present invention to a mobile phone decoration or strap, and FIG. 7(*b*) is a schematic view of fastening a fixation module of the present invention to a sling strap, and FIG. 7(*c*) is a schematic view of fastening a fixation module of the present invention to an X-strap.

In FIG. 7(*a*), a fixation module 3 is installed at a corner of a device body 4, and a buckle 31 of the fixation module 3 is fastened to a mobile phone strap decoration or strap 7 to facilitate users to hold and carry an electronic device 6. In FIG. 7(*b*), the fixation module 3 is installed separately to two corners of a device body 4, and the buckles 31 of the two fixation modules 3 are fastened to both ends of a sling strap 8 to facilitate users to carry the electronic device 6 by slinging the strap over the user's shoulder or across the user's body. In FIG. 7(*c*), the fixation module 3 is installed separately to every corner of the device body 4, and the buckle 31 of each fixation module 3 can be fastened to an end of the X-strap 9, and the X-strap 9 is made of an elastic sling strap to facilitate users to pass a user's palm through the X-strap, and then fix the electronic device 6 to the user's palm.

In summation of the description above, the fixation module of the present invention can be engaged into the groove of the electronic device by the elastic restoring force of the first elastic fixation portion and the second elastic fixation portion, or by locking the first connecting element to the connecting portion and the first installing hole, and thus the fixation element is fixed onto the electronic device. After the fixation module is installed, the user can use the buckle to hook or engage the electronic device onto another object. In addition, the protecting element can prevent foreign substances from entering into the ditch and the press-fit portion is pressed on a side of the buckle to prevent the buckle from falling out. In addition, the buffer element is covered, onto a corner of the casing of the electronic device or covered around the periphery of the casing to reduce the chance of damaging the electronic device by collisions.

While the means of specific embodiments in present invention has been described by reference drawings, numerous modifications and variations could be made thereto by those skilled in the art without departing from the scope and spirit of the invention set forth in the claims. The modifications and variations should in a range limited by the specification of the present invention.

What is claimed is:

1. A fixation module, movably installed into a groove at a corner of a casing of an electronic device, and the fixation module comprising:

a buckle; and a fixation element, having two ends served as a first elastic fixation portion and a second elastic fixation portion respectively, and having a junction disposed between the first elastic fixation portion and the second elastic fixation portion and coupled to the buckle, and the first elastic fixation portion and the second elastic fixation portion being clamped at a position corresponding to the junction to form a V-shape, and a relative distance maintained between the first elastic fixation portion and the second elastic fixation portion being greater than an interval between opposite ends of the groove, such that when an external force is applied to the first elastic fixation portion and the second elastic fixation portion to make the relative distance smaller than the interval, the first elastic fixation portion and the second elastic fixation portion are movably embedded into the groove, and the fixation element is engaged onto a sidewall of the groove by an elastic restoring force of the first elastic fixation portion and the second elastic fixation portion, wherein a connecting portion is protruded outwardly from a side of the first elastic fixation portion or the second elastic fixation portion, and the casing includes a ditch interconnected to the groove, and a sidewall of the ditch includes a first installing hole, such that when the first elastic fixation portion and the second elastic fixation portion are embedded into the groove, the connecting portion is extended along the ditch and moved from an open end of the groove to a predetermined position, so that the position of the connecting portion is corresponsive to the first installing hole, and wherein the fixation module further comprises a first connecting element passed through the connecting portion and the first installing hole to fix the fixation element to the casing.

2. The fixation module of claim 1, further comprising a protecting element including a protecting perforation, and a press-fit portion protruded from an end of the protecting element, and the casing including a second installing hole formed at a periphery of the ditch, such that when the protecting element is covered onto the ditch, the position of the protecting perforation is corresponsive to the second installing hole, and the press-fit portion presses at a side of the buckle.

3. The fixation module of claim 2, further comprising a buffer element including a buffer perforation, such that when the buffer element is covered onto the protecting element, the position of the buffer perforation is corresponsive to the protecting perforation.

4. The fixation module of claim 3, further comprising a second connecting element passed through the buffer perforation, the protecting perforation and the second installing hole to fix the protecting element and the buffer element onto the casing.

5. The fixation module of claim 4, wherein the fixation element is embedded into the groove for installing the fixation module to the electronic device, and after the position of the connecting portion is corresponsive to the position of the first installing hole, the first connecting element is passed through the connecting portion and fixed to the first installing hole.

6. The fixation module of claim 5, wherein the buffer element is covered onto a side of the protecting element, and the position of the buffer perforation is corresponsive to the position of the protecting perforation, and then a combination of the buffer element and the protecting element is covered onto the ditch of the electronic device, so that the positions of the buffer perforation and the protecting perforation are corresponsive to the second installing hole formed at the periphery of the ditch, and the press-fit portion presses on a side of the buckle.

7. The fixation module of claim 6, wherein the second connecting element is passed through the buffer perforation and the protecting perforation and fixed to the second installing hole, after a combination of the buffer element and the protecting element is covered onto the ditch.

8. A fixation module, movably installed into a groove at a corner of a casing of an electronic device, and the casing having a ditch interconnected to the groove, and a sidewall of the ditch including a first installing hole, and the fixation module comprising:

a buckle;

a fixation element, having two ends served as a first elastic fixation portion and a second elastic fixation portion respectively, and having a connecting portion protruded outwardly from a side of the first elastic fixation portion or the second elastic fixation portion, and a junction disposed between the first elastic fixation portion and the second elastic fixation portion and coupled to the buckle, and the first elastic fixation portion and the second elastic fixation portion being clamped at the junction to form a V-shape, and a relative distance between the first elastic fixation portion and the second elastic fixation portion being greater than an interval between opposite ends of the groove, such that when an external force is applied to the first elastic fixation portion and the second elastic fixation portion to keep the relative distance smaller than the interval, the first elastic fixation portion and the second elastic fixation portion are movably embedded into the groove, and the fixation element is engaged onto a sidewall of the groove by an elastic restoring force of the first elastic fixation portion and the second elastic fixation portion, and the connecting portion is moved along the ditch from an open end of the groove to a predetermined position, the position of the connecting portion is corresponsive to the first installing hole; and a first connecting element, being passed through the connecting portion and the first installing hole to fix the fixation element to the casing.

9. The fixation module of claim 8, further comprising a protecting element including a protecting perforation, and a press-fit portion protruded from an end of the protecting element, and the casing including a second installing hole formed at the periphery of the ditch, such that when the protecting element is covered onto the ditch, the position of the protecting perforation is corresponsive to the second installing hole, and the press-fit portion presses on a side of the buckle.

10. The fixation module of claim 9, further comprising a buffer element including a buffer perforation, such that when the buffer element is covered onto the protecting element, the position of the buffer perforation is corresponsive to the protecting perforation.

11. The fixation module of claim 10, further comprising a second connecting element passing through the buffer perforation, the protecting perforation and the second installing hole to fix the protecting element and the buffer element onto the casing.

* * * * *